United States Patent [19]

Morin

[11] Patent Number: 4,714,136

[45] Date of Patent: Dec. 22, 1987

[54] LADDER SUPPORT FOR EAVESTROUGH OR GUTTER

[75] Inventor: Fernand R. Morin, Windsor, Canada

[73] Assignee: Wolverine Aluminum Distributing Ltd., Windsor, Canada

[21] Appl. No.: 46,645

[22] Filed: May 7, 1987

[51] Int. Cl.[4] ..... E04D 13/04; E06C 7/48; E04G 21/24

[52] U.S. Cl. ..... 182/107; 182/214; 182/230; 248/210; 248/48.2; 52/11

[58] Field of Search ..... 182/107, 214, 230, 93; 52/11; 248/210, 48.2

[56] References Cited

U.S. PATENT DOCUMENTS

| | | | |
|---|---|---|---|
| 3,037,579 | 6/1962 | Barrow | 182/107 |
| 3,239,172 | 3/1966 | Chalmers | 52/11 |
| 3,853,202 | 12/1974 | Jarboe | 182/214 |
| 4,164,269 | 8/1979 | Jackson | 182/229 |
| 4,169,570 | 10/1979 | Morin | 248/48.2 |
| 4,185,421 | 1/1980 | Robinson | 182/214 |
| 4,369,860 | 1/1983 | Beane | 182/107 |
| 4,545,460 | 10/1985 | Byrd | 182/107 |
| 4,580,661 | 4/1986 | Thompson | 52/11 |
| 4,601,365 | 7/1986 | Davis | 52/11 |

*Primary Examiner*—Reinaldo P. Machado
*Attorney, Agent, or Firm*—Allen D. Gutchess, Jr.

[57] ABSTRACT

A ladder support is provided for use with an eavestrough or gutter. The support is mounted in the eavestrough without the necessity of using fasteners. It is also mostly concealed by the eavestrough and yet supports the ladder in spaced relationship thereto so that the ladder does not contact the eavestrough and cause damage to it. The ladder support includes two main legs having members at first ends adapted to engage the eavestrough at the juncture of a back wall and a bottom thereof with the legs being of sufficient length to extend above and beyond a front rim of the eavestrough. Second ends of the main legs have brackets for engaging the rails of the ladder to support it spaced from the eavestrough and to resist sideways movement. Outwardly-extending leg braces are affixed to intermediate portions of the main legs and have feet for engaging the interior of the rim for resisting movement of the main legs when a ladder is supported thereby.

21 Claims, 6 Drawing Figures

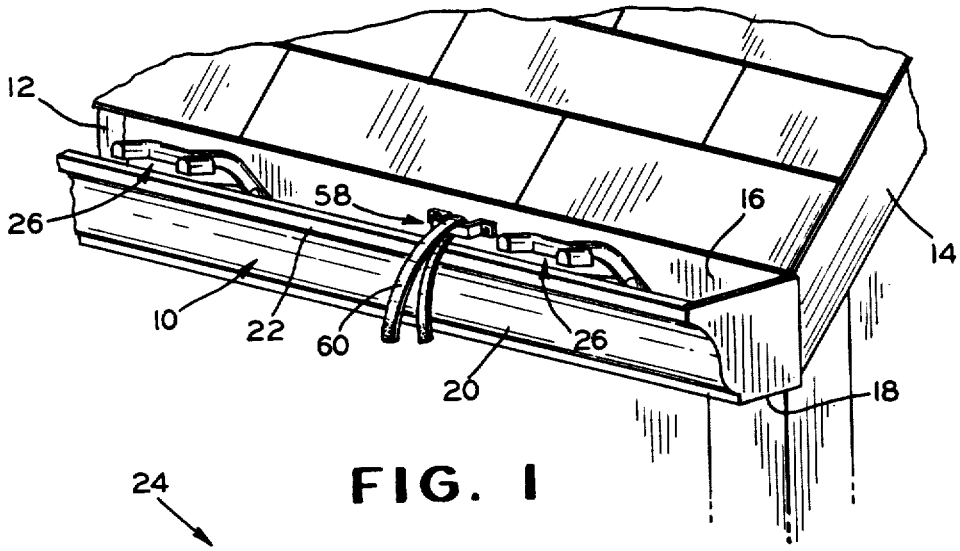
FIG. 1
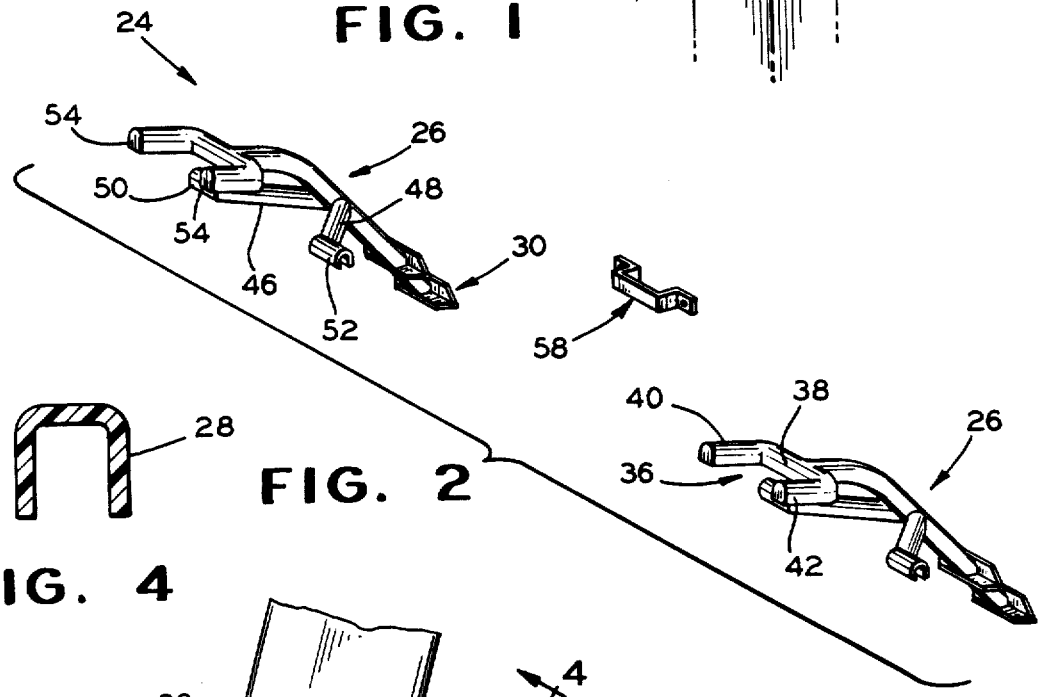
FIG. 2
FIG. 4
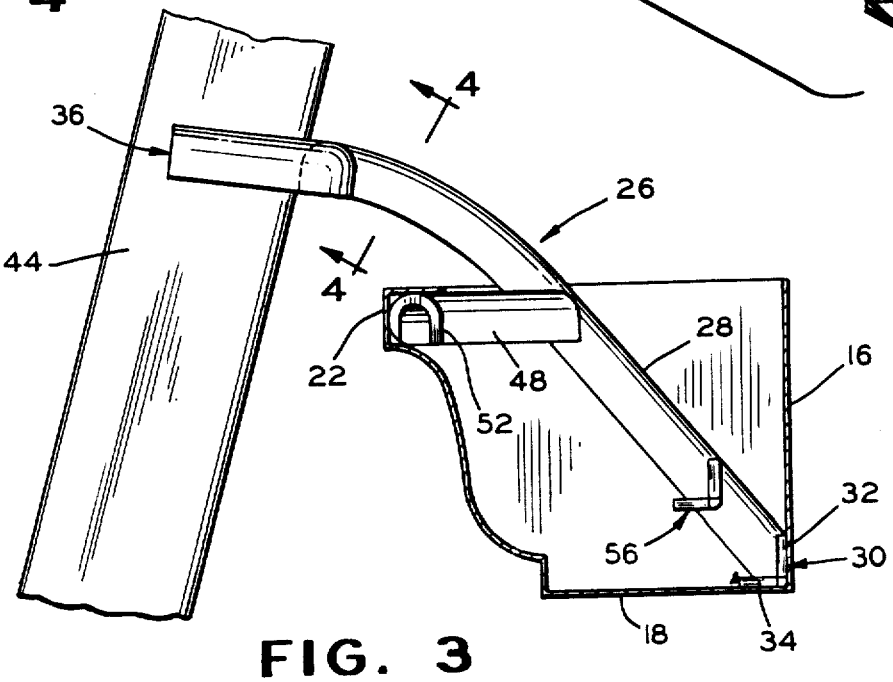
FIG. 3

LADDER SUPPORT FOR EAVESTROUGH OR GUTTER

This invention relates to a ladder support for use with eavestroughs or gutters.

Various ladder supports are known in the art and, for example, are shown in the following U.S. Pat. Nos.: 3,853,202, issued Dec. 10, 1974; 4,185,421, issued Jan. 29, 1980; 4,369,860, issued Jan. 25, 1983; 4,580,661, issued Apr. 8, 1986; and 4,601,365, issued July 22, 1986; and Australian Pat. No. 16,498, published Feb. 9, 1978. All of these ladder supports have had one or more disadvantages.

The present invention provides a ladder support for an eavestrough or gutter having a number of advantages over those heretofore known. The ladder support can be installed in an eavestrough without the requirement for any separate fasteners. The ladder support can be installed permanently and yet can be transferred to another location, if desired. The ladder support spaces the ladder from the eavestrough so that there is no contact therebetween which can damage or marr the eavestrough. At the same time, the ladder support is mostly concealed by the eavestrough for aesthetic purposes. The ladder support also can be used with ladders of various widths and is designed to prevent sideways movement of the ladder, for safety purposes. The support is also separate from the ladder so that the ladder can be used independently of it, without encumberance. The ladder support can also be equipped with a strap loop by means of which a strap can be secured to a rung of the ladder to prevent slipping of the ladder or tipping of the ladder away from the roof.

It is, therefore, a principal object of the invention to provide a ladder support for use with an eavestrough or gutter which can be installed therein without separate fasteners.

Another object of the invention is to provide a ladder support which can be installed permanently in an eavestrough and yet can be moved to other locations, if desired.

Still another object of the invention is to provide a ladder support for an eavestrough or gutter which spaces the ladder therefrom to prevent contact therewith.

Yet another object of the invention is to provide a ladder support which resists sideways movement of the ladder and also prevents the ladder from slipping or tilting outwardly from the roof.

A further object of the invention is to provide a ladder support which is separate from the ladder so that the ladder can be used independently of the support.

Many other objects and advantages of the invention will be apparent from the following detailed description of preferred embodiments thereof, reference being made to the accompanying drawings, in which:

FIG. 1 is a fragmentary view in perspective of an eavestrough or gutter with a ladder support mounted therein in accordance with the invention;

FIG. 2 is a view in perspective of the ladder support of FIG. 1 shown independently of the eavestrough or gutter;

FIG. 3 is a view in transverse cross section taken through the eavestrough or gutter and showing a ladder support component mounted therein in accordance with the invention and supporting a ladder shown fragmentarily;

FIG. 4 is a view in transverse cross section, on an enlarged scale, taken along the line 4—4 of FIG. 3;

Figure 5:
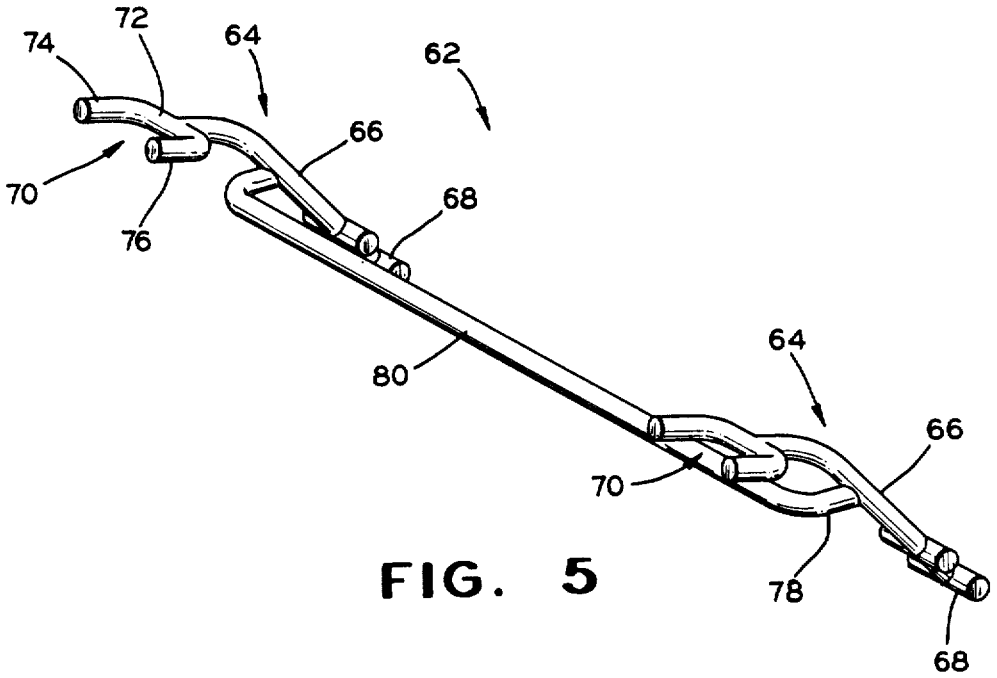
FIG. 5 is a view in perspective similar to FIG. 2 of a modified ladder support.

Referring particularly to FIG. 1, an eavestrough or gutter is indicated at 10 and is mounted on a fascia board 12 at the lower edge of a roof 14. This can be accomplished by hangers (not shown) of the type shown in my U.S. Pat. No. 4,169,507, issued Oct. 2, 1979. The eavestrough 10 includes a back wall 16, a bottom 18, and a front wall 20 terminating in a front rim 22 which is open at the back, as shown in FIG. 3. The eavestrough 10 is commonly made of aluminum and is commonly bent to the desired shape from a coiled strip of aluminum through equipment transported to the site of installation. The eavestrough can thereby be made in substantially any desired length and without having to be transported in long lengths to the site from a central fabrication location. The eavestrough can also be made in modified shapes, such as an "ogee".

Since the material of which the eavestrough is made tends to be soft and relatively easily damaged, a ladder supported against it can often cause denting and/or scratching or other marring. If the ladder is placed in a more upright position against the eavestrough to place less force on it, the ladder is also more subject to tipping away from the roof, presenting a dangerous condition. If the latter is placed against the building wall below the eavestrough, then one climbing onto the roof from the ladder may cause damage to the eavestrough when doing so. This also is dangerous to one when descending from the roof and attempting to find the ladder blindly with his feet.

A ladder support embodying the invention is indicated at 24 in FIG. 2 and includes, in this instance, two separate ladder support components 26 which can be positioned in the eavestrough 10 with desired spacing to accommodate the rails of the ladders of various widths and sizes. Each of the support components 26 includes a main, diagonal leg 28 having an upper curve and being of sufficient length to extend from a location near the juncture of the back wall 16 and the bottom 18 of the eavestrough to a point above and beyond the rim 22 thereof. At a first or lower end of the main leg 28 is a member or right-angle flange 30 having a vertical leg 32 engagable with the bottom 18 of the eavestrough. The ends of the legs are diagonally cut back or tapered, as shown in FIG. 2, to minimize catching dirt or debris which is carried along with rain water in the eavestrough.

A second, upper end of the main leg 28 terminates in a bracket or claw 36 of U-shaped configuration. The bracket includes a web 38 which is structurally integral with the end of the main leg 28 and has outwardly-extending legs 40 and 42 which extend on each side of a ladder rail 44 of FIG. 3. These legs thereby resist sideways movement of the ladder.

At an intermediate portion of the main leg 28, two diagonal legs or braces 46 and 48 extend outwardly. These terminate in feet 50 and 52 which are snapped into the back of the front rim 22 and frictionally engage the surfaces thereof. If desired, the feet 50 and 52 or the braces 46 and 48 can be connected by a cross bar or web to provide greater rigidity.

In installing the ladder support component 26, the flange 30 is first placed against the back wall and bottom of the eavestrough and the rim 22 is then pulled away from the back wall to enable the feet 50 and 52 to be snapped into place in the rim 22, after which the rim is released to enable it to move back to its original position. Thus, the support component 26 can be installed without the use of any tools whatsoever. Further, when the support components 26 are installed, only the brackets 36 are visible from the ground so that the aesthetic appearance of the eavestrough is not seriously comprised. Also, the ladder support 24 can be made of various colors to blend in with various colors of eavestroughs, if desired.

In a preferred form, the support components 26 are made of a polycarbonate plastic material such as "Lexan" available from General Electric Co. Other plastic materials can also be employed, such as polyvinyl chloride.

Also in a preferred form, the various legs, braces, brackets, and feet of the ladder support components 26 are of generally rectangular cross-sectional shape and are preferably hollow with open bottoms, as shown in FIG. 4. This provides rigidity and strength for the support components and yet enables a lesser amount of the plastic material to be used in the manufacture. For appearance purposes, the legs 40 and 42 of the brackets 36 are closed off with end walls 54 to provide a smoother appearance.

Most eavestroughs or gutters come in a five inch size, but a four inch size is also fairly common. In order to accommodate the four inch size, the ladder support component 26 can be made with a second supporting member or flange 56 spaced upwardly on the main leg 28 from the end flange 30. In the use of the ladder support 24 with a smaller, four inch eavestrough or gutter, the main leg 28 can be cut off on diagonal paths parallel to the legs of the supporting flange 56 with the flange 56 then engaging the back wall and bottom of the smaller eavestrough. Also, the flange 56 can be cut off on each side of the main leg 28 when the flange 30 is employed so that the flange 56 will not catch dirt or debris.

The ladder support 24 can also employ a strap loop 58 as shown in FIGS. 1 and 2. This can be affixed to the fascia board 12 through the eavestrough back wall 16 by suitable fasteners (not shown). The location is preferably at an upper portion of the back wall 16 and at an intermediate point between the ladder support components 26. When the ladder is to be used, a connecting strap 60 is led through the loop 58 and is directed around a ladder rung where the ends of the strap 60 can be fastened together by suitable means, such as Velcro strips. The strap 60 is preferably removed when the ladder is not in use. The strap substantially prevents tilting movement of the ladder away from the eavestrough 10 and also resists slipping of the feet of the ladder away from the building.

Figure 6:
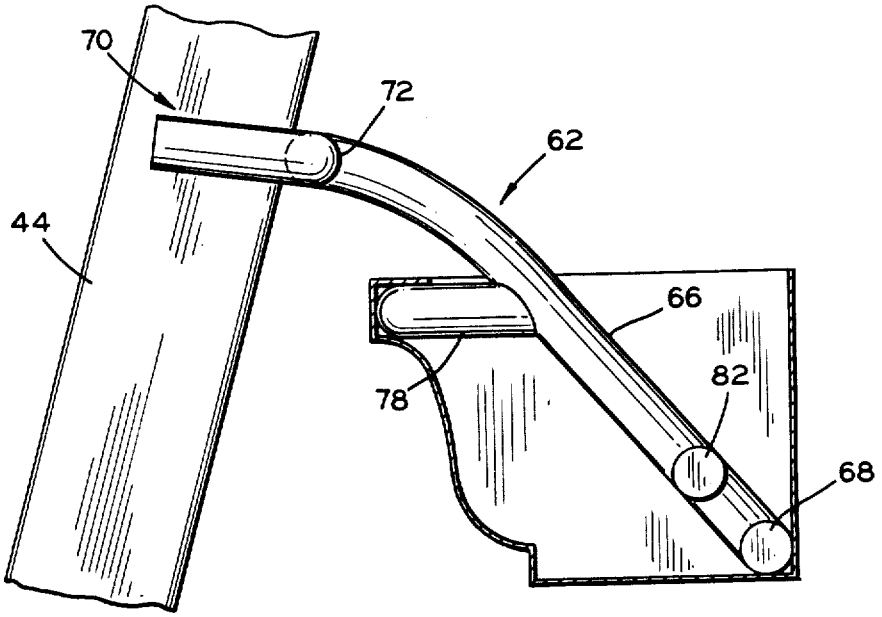
FIG. 6 is a view similar to FIG. 3 of the modified ladder support of FIG. 5.

A one-piece ladder support is indicated at 62 in FIGS. 5 and 6. This includes two ladder support components 64 which can be positioned in the eavestrough 10 with a fixed spacing to accommodate the rails of a ladder of a particular width and size. Each of the support components 64 includes a main, diagonal leg 66 having an upper curve and being of sufficient length to extend from the juncture of the eavestrough back wall and bottom to appoint above and beyond the front rim. A first or lower end of the main leg 66 has a member or rod 68 extending perpendicularly therefrom and engagable with the back wall and bottom of the eavestrough. A second, upper end of the main leg 66 terminates in a bracket 70 of U-shaped configuration. The bracket includes a web 72 having outwardly extending legs 74 and 76 which extend on each side of the ladder rail 44 to resist sideways movement. The legs 74 and 76 can be spaced apart somewhat farther than the legs 40 and 42 to accommodate some variation in ladder width or size.

At intermediate portions of the main legs 66, two leg braces 78 extend outwardly therefrom. These are structurally integral with a single foot or cross bar 80 which holds the components 64 in fixed, spaced relationship and supports them through the leg braces 78 when in use. The foot 80 is received in the back of the eavestrough rim in the same manner as the feet 50 and 52. A strap similar to the strap 60 can also be employed with the strap loop 58 or with a middle portion of the foot 80, if desired.

The ladder support 62 is installed similarly to the support components 26. The members 58 are first placed in position and the rim is then pulled away to enable the foot 80 to be snapped into place in the back of the rim, after which the rim is released so that it may return to its original position.

The ladder support components 64 can also be provided with second support members or rods 82 for smaller eavestroughs. The main legs 66 can be cut off just below the members 82 or the members 82 can be cut off on each side of the main legs 66 when the members 68 are employed with the larger eavestroughs.

Various modifications of the above described embodiments of the invention will be apparent to those skilled in the art and it is to be understood that such modifications can be made without departing from the scope of the invention, if they are within the spirit and the tenor of the accompanying claims.

The embodiments of the invention in which an exclusive property or privilege is claimed are defined as follows:

1. A ladder support to be mounted in an eavestrough for supporting a ladder spaced in front of a front rim of the eavestrough, said support comprising two main legs having means at first ends adapted to engage the eavestrough at the juncture of a back wall and a bottom thereof, said legs being of sufficient length to extend above and beyond the front rim of the eavestrough, means at second ends of said legs to engage the ladder and resist sideways movement thereof, outwardly-extending legs connected to intermediate portions of said main legs, and means at outer ends of said outwardly extending legs for engaging the rim of the eavestrough for resisting movement of said main legs.

2. A ladder support according to claim 1 characterized by said support further comprising a strap loop to be affixed to the back wall of the eavestrough, and a strap extending through said loop and adapted to be affixed around a rung of the ladder engaged by said second end means.

3. A ladder support according to claim 1 characterized by said means at the first ends of said main legs comprising flange means affixed and extending perpendicular to the first ends of said main legs.

4. A ladder support according to claim 1 characterized by said means at the first ends of said main legs comprising rods affixed and extending perpendicularly to the first ends of said main legs.

5. A ladder support according to claim 3 characterized further by there being second flange means affixed to and extending perpendicularly from intermediate portions of said main legs at positions spaced from said flange means.

6. A ladder support according to claim 4 characterized further by there being second rods affixed to and extending perpendicularly from intermediate portions of said main legs at positions spaced from said rods.

7. A ladder support according to claim 1 characterized by said last-named means being a single foot joining said outwardly-extending legs.

8. A ladder support according to claim 1 characterized by said last-named means being separate feet connected to said outwardly-extending legs.

9. A ladder support according to claim 1 characterized by there being two of said outwardly-extending legs extending outwardly from each of said main legs, and said last-named means comprising a foot located at the outer end of each of said outwardly-extending legs.

10. A ladder support to be mounted in an eavestrough for supporting a ladder spaced in front of a front rim of the eavestrough, said support comprising two diagonal legs having members at lower ends thereof adapted to engage the eavestrough at the juncture of a back wall and a bottom thereof, said diagonal legs being of sufficient length to extend above and beyond the front rim of the eavestrough, brackets at upper end of said diagonal legs to engage rails from the ladder to support the ladder spaced from the rim of the eavestrough and to resist sideways movement of the ladder, leg braces affixed to intermediate portions of said diagonal legs and extending outwardly therefrom, and means at outer ends of said leg braces for engaging the rim of the eavestrough from the back thereof for resisting movement of said diagonal legs relative to the eavestrough.

11. A ladder support according to claim 10 characterized by said last-named means being a single foot joining said leg braces.

12. A ladder support according to claim 10 characterized by said last-named means being separate feet connected to said leg braces.

13. A ladder support according to claim 10 characterized by there being two of said leg braces extending outwardly from each of said diagonal legs, and said last-named means comprising a foot located at the outer end of each of said leg braces.

14. A ladder support according to claim 10 characterized by said members at the lower ends of said diagonal legs comprising flange means affixed and extending perpendicularly to the lower ends of said diagonal legs.

15. A ladder support according to claim 10 characterized by said members at the lower ends of said diagonal legs comprising rods affixed and extending perpendicularly to the lower ends of said diagonal legs.

16. A ladder support according to claim 14 characterized further by there being second flange means affixed to and extending perpendicularly from intermediate portions of said main legs at positions spaced from said flange means.

17. A ladder support according to claim 15 characterized further by there being second rods affixed to and extending perpendicularly from intermediate portions of said main legs at positions spaced from said rods.

18. A ladder support to be mounted in an eavestrough for supporting a ladder spaced in front of a front rim of the eavestrough, said support comprising two diagonal legs having members at lower ends thereof extending perpendicularly therefrom for engaging a part of the eavestrough, upper ends of said diagonal legs having brackets for engaging rails of the ladder to support the ladder spaced from the eavestrough and to resist sideways movement of the ladder, foot means adapted to engage the rim of the eavestrough, and means connecting said diagonal legs relative to the eavestrough.

19. A ladder support according to claim 18 characterized by said foot means being a common foot joined to said connecting means.

20. A ladder support according to claim 18 characterized by there being two of said connecting means for each of said diagonal legs, and each of said connecting means having said foot means at outer ends thereof.

21. A ladder support according to claim 18 characterized by said foot means being separate feet for each of said connecting means.

* * * * *

UNITED STATES PATENT OFFICE

CERTIFICATE OF CORRECTION

Patent No. 4,714,136 Dated December 22, 1987

Inventor(s) Fernand R. Morin

It is certified that error appears in the above-identified patent and that said Letters Patent are hereby corrected as shown below:

In the claims:

Claim 18, line 11, for "diagonal legs relative to the eavestrough" substitute --foot means to said diagonal legs for resisting movement of said diagonal legs relative to the eavestrough--.

Signed and Sealed this

Fourteenth Day of June, 1988

*Attest:*

DONALD J. QUIGG

*Attesting Officer*

*Commissioner of Patents and Trademarks*